United States Patent [19]

Lebourg

[11] Patent Number: 4,989,578

[45] Date of Patent: Feb. 5, 1991

[54] METHOD FOR FORMING DIAMOND CUTTING ELEMENTS FOR A DIAMOND DRILL BIT

[76] Inventor: Maurice P. Lebourg, 5592 Longmont, Houston, Tex. 77056

[21] Appl. No.: 400,510

[22] Filed: Aug. 30, 1989

[51] Int. Cl.[5] ..... B28D 1/32; B28D 5/04; E21B 10/00

[52] U.S. Cl. ..... 125/23.01; 125/390; 51/283 R; 175/410

[58] Field of Search ..... 125/30 R, 39, 23 R; 175/410, 329, 330; 51/283 R

[56] References Cited

U.S. PATENT DOCUMENTS

| | | | |
|---|---|---|---|
| 2,199,692 | 5/1940 | Catland | 255/61 |
| 2,423,777 | 7/1947 | Jearum | 125/30 R |
| 3,027,952 | 4/1962 | Brooks | 175/329 |
| 3,311,181 | 3/1967 | Fowler | 175/410 |
| 3,318,399 | 5/1967 | Garner | 175/329 |
| 3,997,011 | 12/1976 | Staroba | 175/400 |
| 4,109,737 | 8/1978 | Bovenkerk | 175/329 |
| 4,254,840 | 3/1981 | Shay, Jr. | 175/410 |
| 4,373,593 | 2/1988 | Phaal et al. | 175/329 |
| 4,471,845 | 9/1984 | Jurgens | 175/329 |
| 4,643,161 | 2/1987 | Kim . | |
| 4,697,654 | 10/1987 | Barr . | |
| 4,716,976 | 1/1988 | Isakov | 175/410 |
| 4,858,706 | 8/1989 | Lebourg | 175/329 |

OTHER PUBLICATIONS

Catalog entitled, "Diamond Drilling", of Diamant Boart Discloses Various Diamond Drill Bits Offered by Diamant Boart.

Catalog Entitled, "J-K-S Diamond Bits", Discloses Various Diamonds that are Used in Drill Bits.

*Primary Examiner*—Frederick R. Schmidt
*Assistant Examiner*—Bruce P. Watson
*Attorney, Agent, or Firm*—Arnold, White & Durkee

[57] ABSTRACT

A method of forming hemispherically shaped diamond cutting elements for use in a rotary drill bit is provided. The method includes identifying a cleaving plane in a diamond and a perpendicular axis, polishing the diamond to form a series of truncated cones approximating a hemisphere around said axis, and cleaving the diamond to form a cutting face.

10 Claims, 6 Drawing Sheets

Fig.1
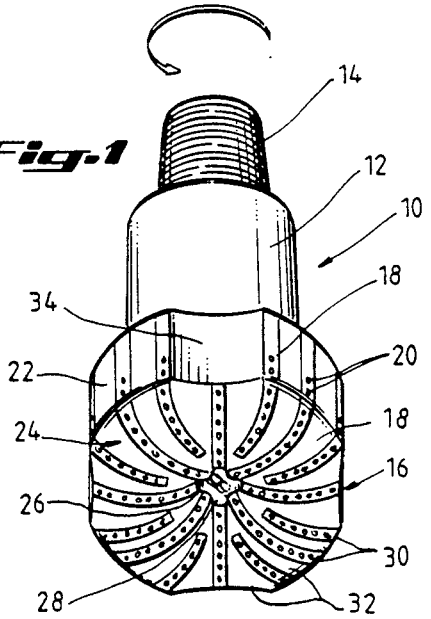
Fig.2
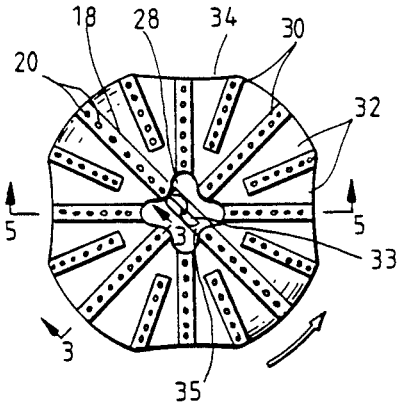
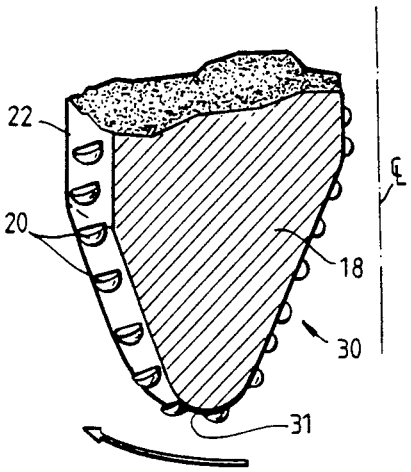
Fig.3
Fig.3A
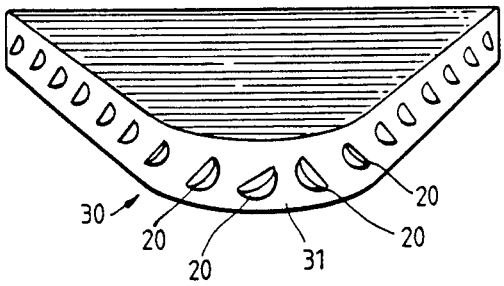
Fig.5
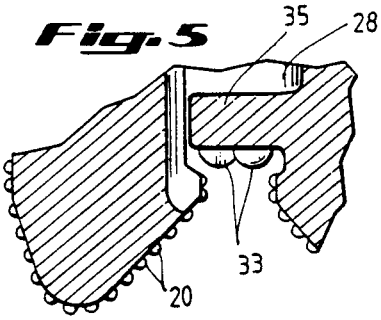
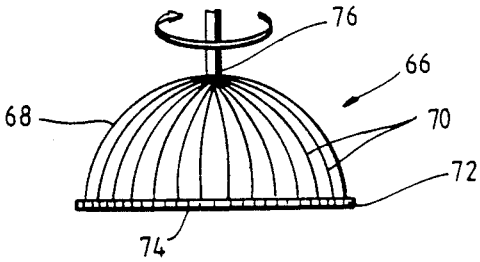
Fig.11

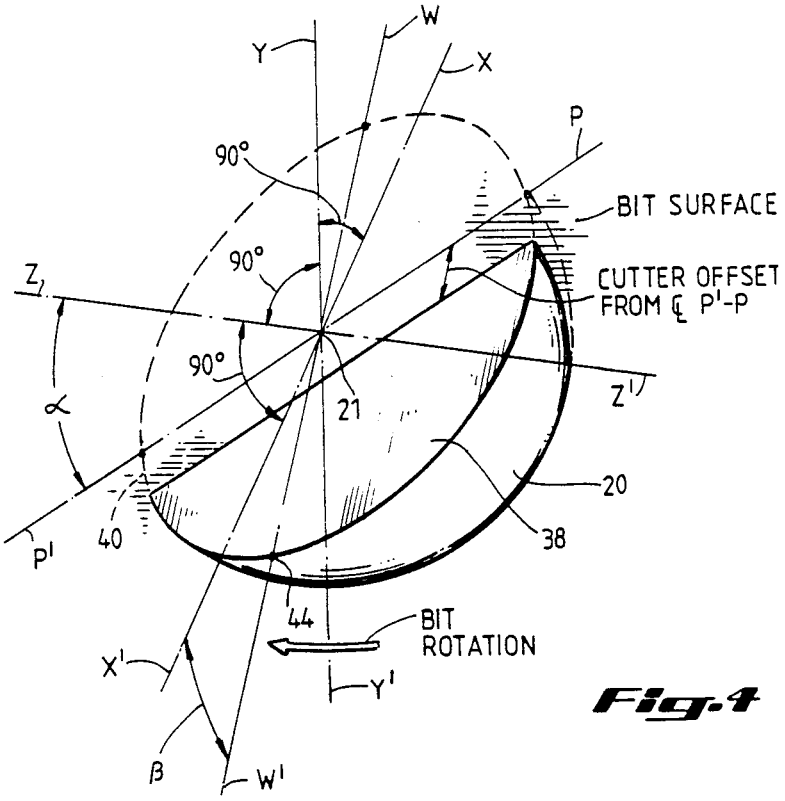
Fig.4
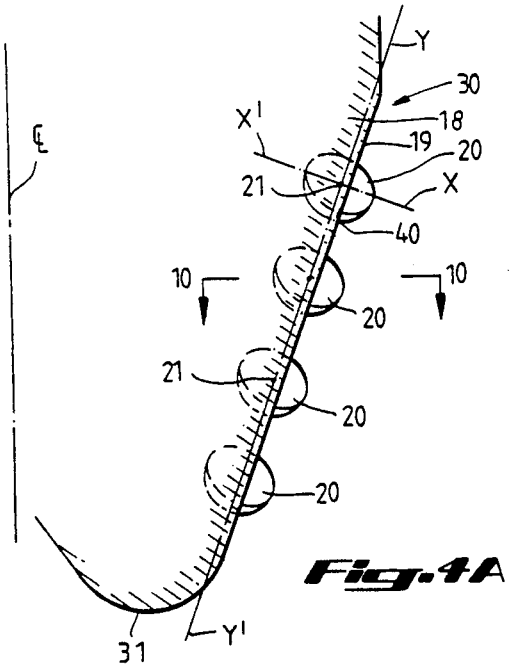
Fig.4A
Fig.10
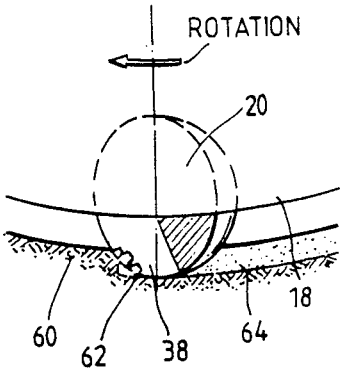

Fig. 6
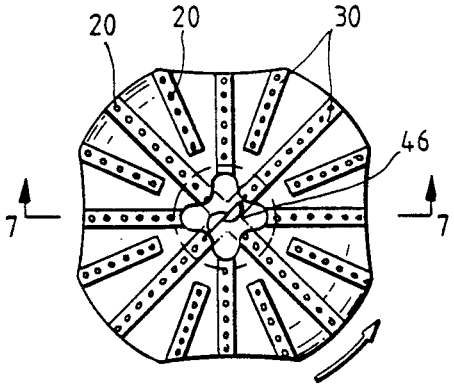
Fig. 7
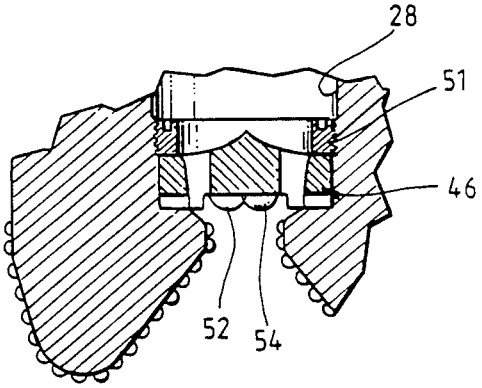
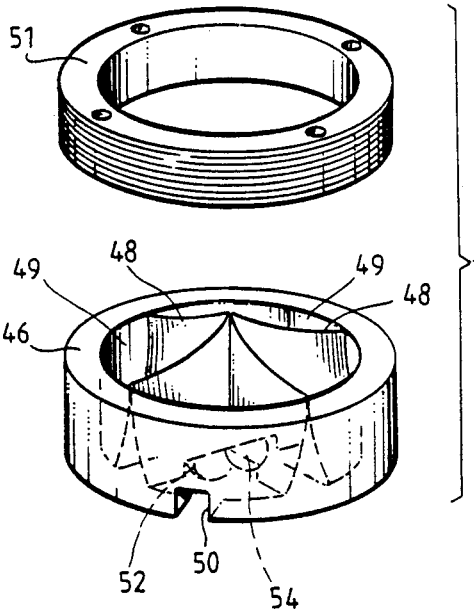
Fig. 8
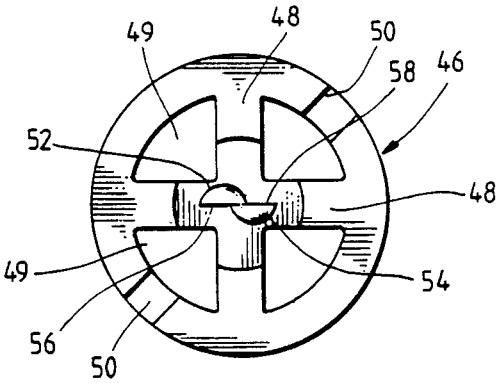
Fig. 9

Fig.12A
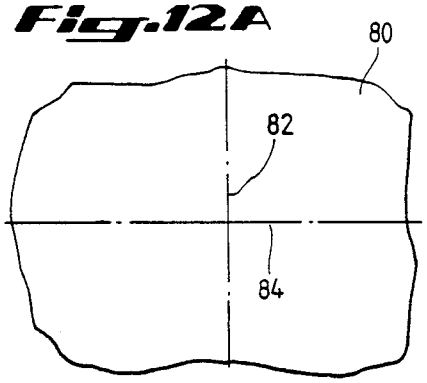
Fig.12B
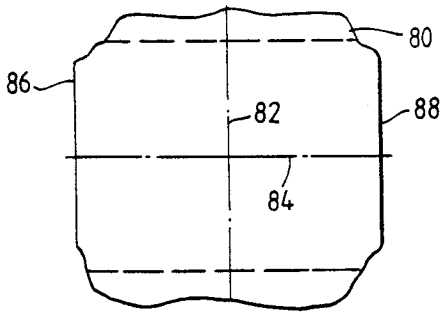
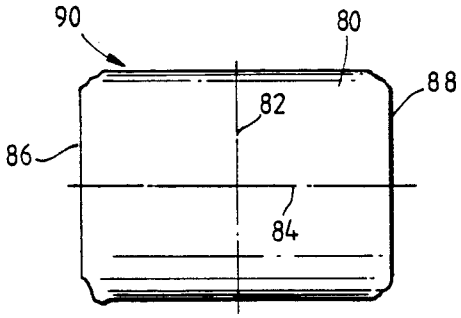
Fig.12C
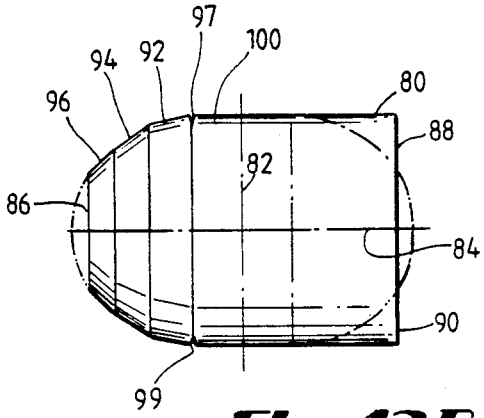
Fig.12D
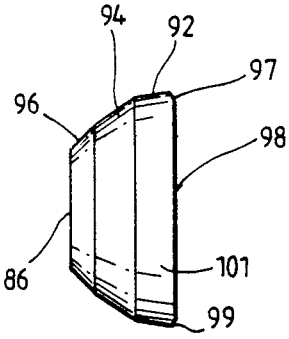
Fig.12E
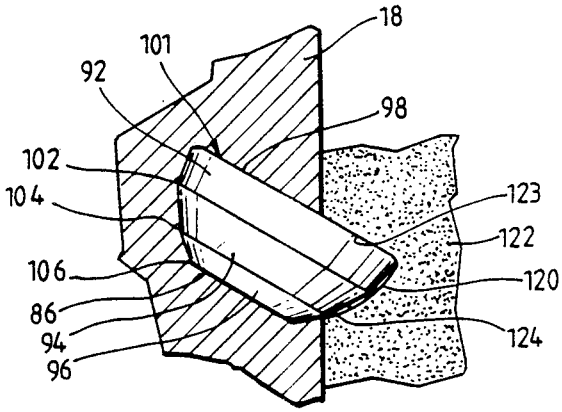
Fig.13

METHOD FOR FORMING DIAMOND CUTTING ELEMENTS FOR A DIAMOND DRILL BIT

BACKGROUND OF THE INVENTION

The present invention relates to rotary drill bits for drilling boreholes into subterranean formations. More particularly, the invention relates to method of forming diamond elements for use in a novel rotary bit design utilizing diamond cutting elements.

Drill bits utilizing diamonds or similar hard cutting elements are commonly employed in drilling and coring operations, particularly in hard subterranean formations such as chert, quartzitic sandstones or the like. The construction of such diamond drill bits usually includes a body portion having means for interconnection of the bit onto a drill string, and a matrix portion for mounting the diamonds or other cutting elements. Drilling fluid is directed down to the bottom of the borehole through the drill string and from a port generally disposed in the central portion of the bit. Fluid passageways or water courses that cross the drilling surfaces of the bit are also provided to transport this drilling fluid across the bit face to cool and lubricate the drilling surface of the bit and to facilitate movement of drill cuttings from the drilling area.

The general theory of diamond bit operation is not simply to crush the formation and thereby make drilling progress, but rather to create tiny fractures as the cutting elements pass over the formation so that drilling fluid which is maintained at a higher pressure than the formation pressure, can enter these fractures and remove the fractured portions of the formation. While most diamond bits use this crushing or fracturing action to create the hole, some bits have been developed which utilize a shearing action to cut through the formation.

Many different types of "diamond" cutting elements have been developed and used. These include natural diamonds, synthetic diamonds, and composites which include combinations of diamonds with other compounds such as tungsten carbide. Additionally, many different types of diamond shapes have been used. These include natural round stones, mechanically and chemically rounded and polished stones, natural cubic stones and natural octahedral stones. These stones have been inserted in many different configurations in diamond drill bits and in bits of many different shapes.

Although diamond drill bits are the best type of bit for hard formations, their penetration rate is lower than other types of bits since they generally have to rely on crushing and fracturing action to cut through the formation. Accordingly, it would be a significant advancement in the art to provide a diamond drill bit which retains the advantages of having the hard diamonds as the cutting elements while providing a means for increasing the penetration rate of the bit. Such a bit is disclosed and claimed herein.

SUMMARY OF THE INVENTION

The present invention provides a novel drill bit which utilizes hemispherically shaped diamond inserts having a cleaved face to cut through rock formations. The diamond inserts can be formed by cleaving round diamonds in half. Alternatively, the diamond inserts can be formed by polishing and cleaving diamonds having other shapes.

In a preferred embodiment, the diamond inserts are formed from various shapes of natural diamonds. A diamond is selected and studied to determine the cleaving plane and its perpendicular axis. The diamond is then cut along two planes parallel to the central cleaving plane. The diamond is then polished to form a cylinder having as its axis, the axis perpendicular to the cleaving plane.

One end of the cylinder is then further polished to form a series of conical sections havign different angles to approximate a hemisphere. The diamond can then be cleaved to form a hemisphere. Depending on the shape and size of the diamond, the cleaved plane of the hemisphere may be the same as or parallel to the central cleaving plane.

The drill bit comprises a body portion having a matrix for holding the diamonds in place. Passageways are created across the face of the matrix to allow drilling fluid to cool and lubricate the bit and carry cuttings away. These passageways divide the face of the drill bit into a plurality of fins. A plurality of hemispherically shaped diamond cutting elements are mounted in each of the fins.

The hemispherically shaped diamond cutting elements are embedded in the matrix of the bit such that a portion of the cleaved, planar face of each element is exposed. The elements are positioned such that they have a leading edge in the direction of rotation of the bit and an outer edge which is distal from the matrix. The leading edge is inclined downward at a first angle $\alpha$ from a plane normal to the face of the bit and parallel to the direction of rotation to create a pitch. The outer edge is inclined downward at a second angle $\beta$ from a plane normal to the face of the bit and parallel to the intersection of the planar face of the diamond element with the face of the bit.

The diamond edge penetrates and fractures the formation progressively and at the same time removes the fractured cuttings by grooving with the rotation of the bit. The pressure on the diamond is directed on the cleaved face which provides the maximum resistance without damaging the diamond.

The angle of inclination to create the pitch can be varied within suitable ranges depending upon the type of formation in which the bit will be used. For example, in extremely hard formations, the angles are smaller such that less material is removed with each rotation of the bit. For bits which are used in softer formations, the angles can be increased to provide for greater penetration rates.

When the diamond inserts are formed from a series of conical sections approximating a sphere, the points between adjacent sections help anchor the inserts in the matrix. Since the forces exerted on the diamond elements are only applied to one edge of the face, a torque is created which tries to turn the elements in the matrix. The sharp points between conical sections help resist the forces that are trying to turn the elements.

In the preferred embodiment, a plurality of fins are provided and only a single row of diamond cutting elements is arranged in each fin. However, it is also possible to provide arrangements with diamond cutting elements side-by-side, provided that the cutting surfaces of the diamonds are properly aligned.

The grooving action of the cleaved diamonds can complete the fracturing of the debris and remove the fractured pieces which are held in place by the hydraulic pressure of the drilling mud in addition to simply fracturing the rock formation.

One advantage of the drill bit of the present invention is that it provides faster penetration rates than conventional diamond drill bits. The cutting action of the hemispherically shaped diamond inserts which slice and groove into the formation creates a borehole faster than the crushing and fracturing action of the prior art drill bits. A further advantage of the present invention is that the diamond cutting elements can be recycled by removing them from the matrix and rotating them such that a new edge of the hemisphere is exposed. Another advantage is that the major cutting forces are applied to the cleaved face of the diamond. These and other advantages of the present invention will be more fully apparent from the following description and attached drawings taken in conjunction with the claims.

BRIEF DESCRIPTION OF THE DRAWINGS

FIG. 1 is a perspective view of a drill bit embodying the present invention;

FIG. 2 is a plan view of the crown end of the drill bit of FIG. 1;

FIGS. 3 and 3A are perspective views of a slice of the bit illustrated in FIGS. 1 and 2;

FIGS. 4 and 4A–4C are schematic views illustrating the orientation of the diamond inserts in the matrix of the bit;

FIG. 5 is a partial cross-sectional view of the bit of FIGS. 1 and 2;

FIG. 6 is a plan view of the crown end of a second preferred embodiment of the present invention;

FIG. 7 is a partial cross-sectional view of the bit of FIG. 6.

FIG. 8 is a perspective view of the center cutting element of the bit of FIGS. 6 and 7.

FIG. 9 is a bottom plan view of the element of FIG. 8.

FIG. 10 is a cross-sectional view taken along line 10—10 of FIG. 4A showing the grooving action of the diamond inserts of the present invention.

FIG. 11 is a plan view of a tool used to form a mold for casting the bit of the present invention.

FIGS. 12A–12E are schematic illustrations showing the steps involved in forming diamond inserts according to a preferred embodiment of the invention.

FIG. 13 is a cross-sectional view of a portion of a drill bit showing the insert of FIG. 12E embedded within a matrix.

DETAILED DESCRIPTION OF THE PREFERRED EMBODIMENTS

Figure 4B:
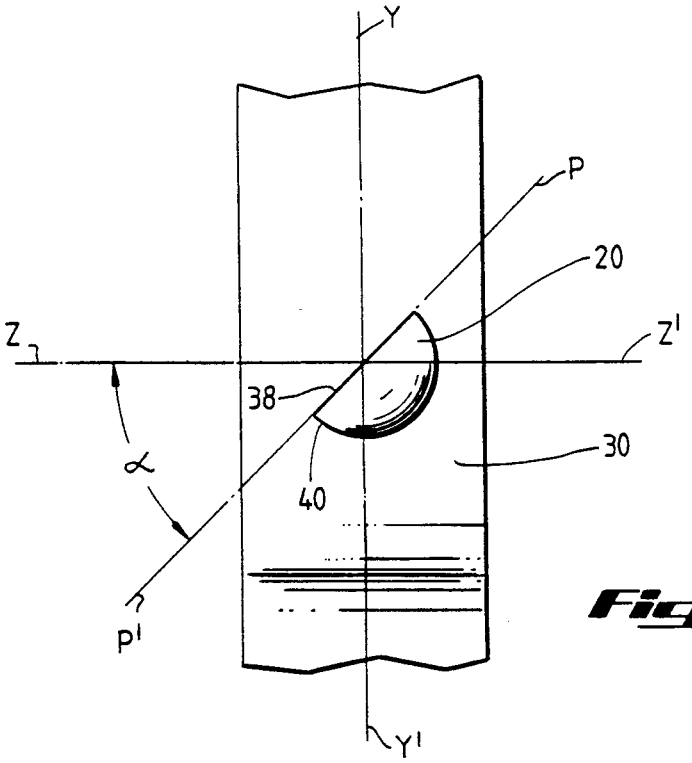

The present invention provides a novel design for a drill bit which utilizes cleaved, hemispherically shaped diamond cutting elements to provide a bit having increased penetration rates.

Referrence is now made to the drawings in which like parts are designated with like numerals throughout. Illustrated in FIGS. 1 and 2 is a drill bit 10 of the type which may be constructed in accordance with the instant invention. Drill bit 10 comprises a body 12 formed of suitable material to withstand stress during operation. The upper portion of the body is provided with an exteriorly threaded neck 14 so that the bit 10 may be interconnected at the bottom of a drill string. The lower body section or crown 16 of the bit 10 is surfaced with a metal matrix 18 in which the diamond cutting elements 20 may be embedded. The matrix is a relatively hard, tough material such as bronze, or a similar metal alloy such as copper nickel alloy containing powdered tungsten carbide in quantities sufficient to convey the required strength and erosion resistance. Alternatively, the matrix may be composed of a suitably hard plastic material capable of being cast upon the bit and having the properties of resisting wear and retaining the cutting elements. The material is of a suitable thickness to provide the required strength, resistance to erosion and abrasion, and to embed the diamond cutting elements firmly therein.

In casting the matrix material upon the bit body 12, it is common to provide recesses or a roughened surface on the bit body so that the matrix material will rigidly and firmly anchor to the bit body and form a permanent and fixed part of the drill bit.

In the embodiment illustrated in FIG. 1, the matrix of the drill bit is shaped to have a generally semitoroidal end face defining an outer cylindrical gauge face 22, a lower, generally curved drilling face 24, and an interior coring face 26. The interior face 26 opens into a central passageway 28 extending through the bit body, and through which drilling fluid is directed down the drill string to the formation and across the face of the bit. Matrix 18 is formed such that it has a plurality of fins 30 into which the diamond cutting elements 20 are embedded.

Fins 30 define a plurality of channels or water courses 32 which extend outwardly from the central passageway in the interior face, across the drilling face and up the gauge face of the bit. Accordingly, drilling fluid delivered through the drill pipe through passageway 28 is distributed through these flow passageways or water courses 32 to wash cuttings from the drilling area and upwardly to the top of the well as is well-known in the art. Additionally, in the embodiment illustrated, the matrix of the bit is provided with a series of junk slots 34 which are designed to discharge cuttings from the drilling area. It should be noted that a number of other configurations suitable for use in a diamond drilling bit would be obvious to those skilled in the art.

As can be best be seen in FIG. 5, a pair of hemispherically shaped diamond cutting elements 33 are placed in a projection 35 in central passageway 28. Cutting elements 33 remove the core that is formed as drilling face 24 progresses through the formation.

Reference is next made to FIGS. 3, 3A, 4 and 4A–4C which illustrate the manner in which diamond cutting elements 20 are embedded in the matrix 18 in accordance with the teachings of the present invention. Cutting elements 20 have a hemispherical shape and a planar surface 38 formed by cleaving a diamond. In one embodiment, cutting elements 20 are obtained by cleaving a round diamond in half.

Figure 4C:
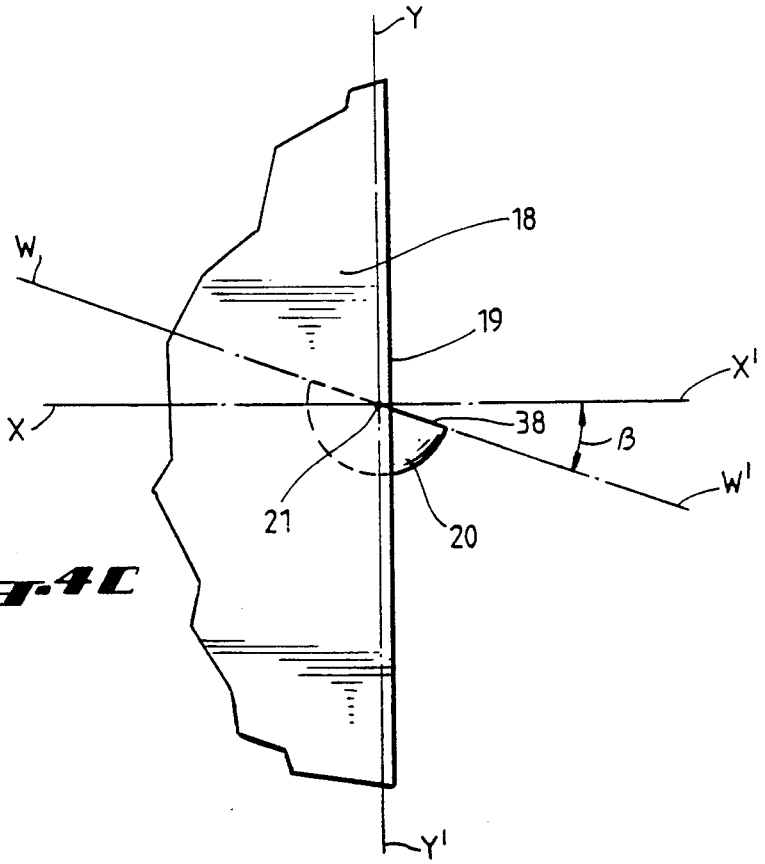

As can best be seen in FIG. 4A and 4C, diamond cutting elements 20 are embedded in matrix 18 such that the center 21 of each element 20 is behind face 19 of matrix 18. Accordinglty, slightly over half of each cutting element 20 is embedded within the matrix to ensure that the elements are securely fixed in place.

Diamond cutting elements 20 are oriented within matrix 18 of fins 30 to provide the optimum cutting surface. Generally, the rounded surface of cutting element 20 is oriented toward the lowermost tip 31 of fin 30. The orientation of elements 20 can best be seen with reference to FIGS. 4 and 4A.

Illustrated in FIG. 4 are lines X—X', Y—Y' and Z—Z' which are oriented at 90 degrees to each other to define a three dimensional space and which intersect each other at center 21 of diamond element 20. The plane defined by Lines Y—Y' and Z—Z' is parallel to face 19 of fin 30 with line Y—Y' passing through the center 21 of diamond element 20. It should be appreciated that while line Y—Y' has been shown as a straight line for purposes of illustration in FIG. 4A, it is parallel to face 19 of fin 30 and will be a curved line where face 19 is curved. Line X—X' is perpendicular to face 19 of fin 30.

The flat or planar surface 38 which is defined by the cleaved face of element 20 is rotated in two directions with respect to the plane defined by lines X—X' and Z—Z'. First, as shown in FIG. 4B, leading edge 40 of element 20 is inclined downward around the X—X' axis at a first angle $\alpha$ as illustrated by line P—P' to create a pitch. This permits cutting element 20 to groove down into the rock formations. Angle $\alpha$ can be increased or decreased depending upon the type of formation in which the bit will be used. Generally, angle $\alpha$ is within the range of 30–60 degrees. Preferably, angle $\alpha$ is about 45 degrees.

The outer edge 44 of diamond cutting element 20 is also inclined downward around the P—P' axis from a plane defined by lines X—X' and P—P' at a second angle $\beta$ as illustrated by line W—W' in FIG. 4. This downward inclination exposes the sharp cutting edge 44 and planar surface 38 of cutting element 20 to the formation being drilled. If angle $\beta$ is formed before angle $\alpha$, the rotation occurs around the Z—Z' axis as illustrated in FIG. 4C. Angle $\beta$ can also be adjusted within a suitable range depending upon the size of the cutting element and the hardness of the formation in which bit 10 will be used. Generally, angle $\beta$ is within the range of 15–30 degrees. Preferably, angle $\beta$ is about 30 degrees.

As can be seen from the foregoing, lines P—P' and W—W' define the planar surface 38 of element 20. This plane is rotated in two directions from the plane defined by lines X—X' and Z—Z' if angle $\beta$ is created first. Otherwise, angle $\beta$ is measured from the plane defined by lines X—X' and P—P'.

As can be seen in FIGS. 3 and 3A, the orientation of diamond cutting elements changes as they progress from the outer face to the interior face of bit 10. The greatest change occurs adjacent lowermost tip 31 of fin 30.

Reference is next made to FIGS. 6–9 which illustrate another preferred embodiment of the present invention. In this embodiment, fins 30 are substantially identical to the embodiment illustrated in FIGS. 1 and 2. A core cutting insert 46 is provided at the center of central passageway 28 to remove the core which is left as the formation disk shaped with crossbars 48 and openings 49 formed in the center thereof. Insert 46 is positioned in central passageway 28 and is secured in place by threaded ring 51. Openings 49 permit drilling fluid to pass through insert 46 to clean and lubricate the face of bit 10. The upper edges of crossbars 48 are tapered to create as little turbulence as possible as the fluid passes through openings 49.

A pair of notches 50 are formed in the bottom of insert 46 to permit east alignment of insert 46 within central passageway 28. The notches 50 also help prevent rotation of insert 46 within bit 10.

A pair of diamond cutting elements 52 and 54 are positioned in crossbars 48 for removing the core. Diamond cutting elements 52 and 54 are generally hemispherical in shape and are formed by cleaving generally round diamonds in half. The flat faces 56 and 58 of elements 52 and 54 are positioned such that they face each other. However, elements 52 and 54 are offset such that they only slightly overlap each other. When diamond cutting elements 52 and 54 become worn or break, insert 46 can easily be removed and replaced. Because the core is not supported, it is easily destructed in small fragments without retartding the penetration of the bit.

Reference is next made to FIG. 10 which illustrates the cutting and grooving action of diamond cutting elements 20. As planar surface 38 of cutting element 20 engages rock formation 60, it fractures and grooves the rock thus forming pieces 62 which are carried away by the drilling fluid. A groove 64 is formed in rock formation 60 by the cutting action of element 20. As can further be seen in FIG. 10, only an outer portion 39 of element 20 engages rock formation 60. Accordingly, a space 61 remains between matrix 18 of the bit and rock formation 60. This provides a passageway for removal of chipped rock.

The diamond inserts of the present invention have an advantage over PDC cutters since the inserts are formed from a single crystal. Heat generated while cutting a rock formation is more readily dissipated throughout the diamond and into the bit matrix. This prolongs the life of the cutter.

FIG. 11 illustrates a tool 66 which can be used in the formation of a mold for casting bit 10. Generally, diamond bits are formed by mounting the diamonds in a graphite mold which is then filled with a metal powder that is sintered to form the matrix which holds the diamonds. Tool 66 includes a hemispherically shaped body 68 which is covered with a plurality of cutting blades 70. A ring 72, also covered with cutting blades is formed adjacent planar face 74 of body 68.

Body 68 is mounted on a shaft 76 for attachment to a suitable mill. Tool 66 is rotated by the mill and cuts a portion of a hemispherically shaped hole in the graphite mold into which diamond cutting elements 20 can be mounted. Since the edge of body 68 adjacent planar face 74 tends to wear first, ring 72 is provided to create a slightly larger opening adjacent the planar face. This ensures that the hole created by tool 66 is properly sized to receive the diamond cutting element 20, especially the sharp edge adjacent the cleaved face.

Figure 15:
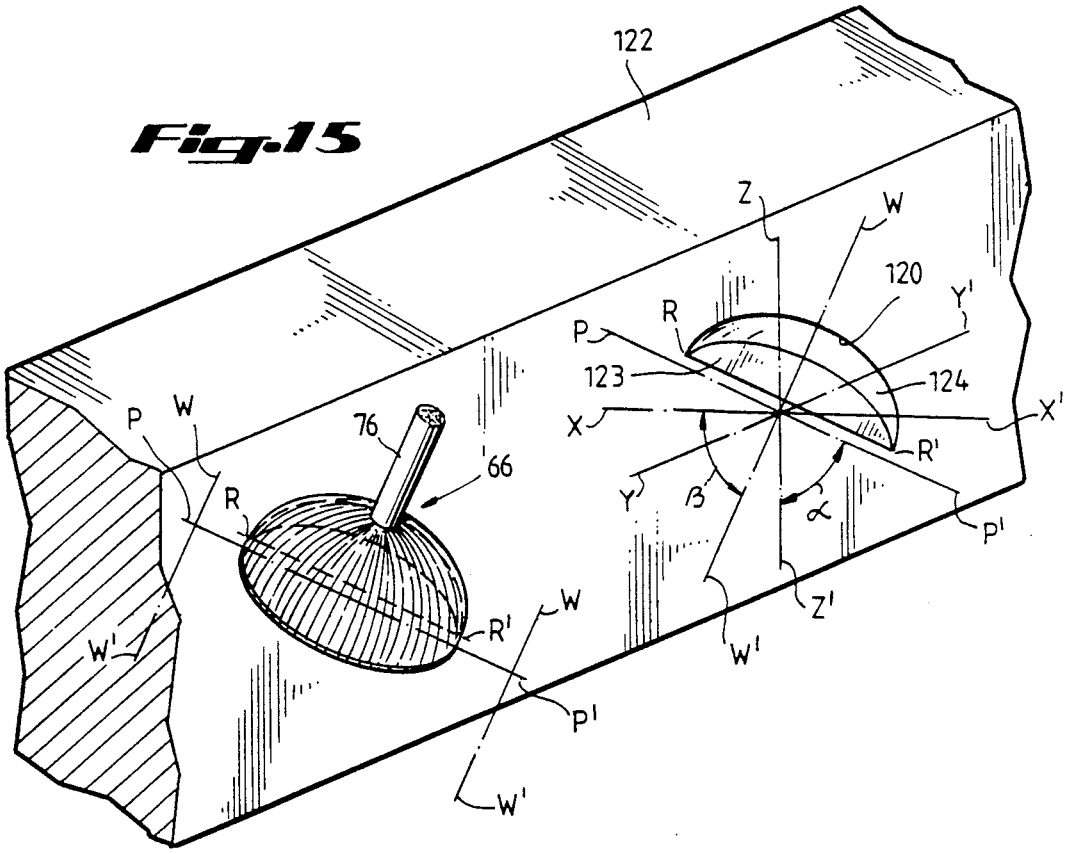
FIG. 15 is a perspective view of a portion of a mold showing the formation of holes to receive a diamond insert.

FIG. 15 illustrates the cutting of holes 120 in a mold 122 using tool 66. Mold 122 corresponds to the face of a fin 30. Shaft 76 of tool 66 is attached to a suitable mill which can be programmed to cut holes 120 having a planar surface 123 corresponding to the cleaved face of the diamond inserts and a concave surface 124 corresponding to the curved portion of the hemispherically diamond inserts. The axes of the hole 120 are shown by lines X—X', Y—Y', Z—Z', P—P' and W—W' which correspond to the axes illustrated in FIG. 4.

As tool 66 cuts holes 120, it moves along a plane defined by lines P—P' and W—W'. Methods of clamping mold 122 and programming a suitable mill are well known to those skilled in the art.

FIGS. 12A–12E illustrate a method whereby hemispherical inserts whithin the scope of the present invention can be formed from diamonds which are not round. In this process, a generally round diamond 80 is studied to determine a central cleaving plane 82 and the perpendicular axis 84 as shown in FIG. 12A. The diamond is then cut along two planes 86, 88 which are parallel to cleaving plane 82 as shown in FIG. 12B. Diamond 80 is then rotated about axis 84 and polished as shown in FIG. 12C to form a cylinder 90.

Cylinder 90 is then polished on one end is a series of steps to form a series of conical sections 92, 94, 96 as shown in FIG. 12D to approximate a hemisphere. While the illustrated embodiment shows three conical sections, it will be appreciated by those skilled in the art that different numbers of sections could be used and the angle of each section with respect to the axis 84 could be varied. The determination of the proper angles is within the level of skill in the art.

Diamond 80 is then notched at 97 and 99 so that it can be cleaved along plane 98 to form a hemisphere 101 as illustrated in FIG. 12E. Depending upon the shape of diamond 80 and the length of cylinder 90 additional hemispheres can be formed from the same diamond by repeating the polishing and cleaving steps illustrated in FIGS. 12D and 12E.

Any remaining portions of cylinder 90 can be cleaved to form diamond discs 100 as shown in FIG. 12D. These discs can be used in conventional diamond drill bits in place of synthetic diamond discs. The portion of diamond 80 that can be formed into discs 100 is used as a base to grasp the diamond as the conical sections are being polished.

An advantage of this method of forming hemispherical diamond inserts can be seen in FIG. 13. A series of sharp ridges 102, 104, 106 encircling hemisphere 101 are formed between the various conical sections. When hemisphere 101 is cast into matrix 18, ridges 102, 104 and 106 help anchor the diamond and prevent it from rotating as forces are applied to the face of the diamond during use.

A portion of mold 122 with hole 120 formed therein is also illustrated in FIG. 13. Cleaved plane 98 of hemisphere 101 is positioned along planar surface 123 of hole 120. Ridges 102 and 104 are positioned adjacent concave surface 124. Hemisphere 101 is glued into hole 120 to secure it in place while matrix 18 is being formed.

Figure 14:
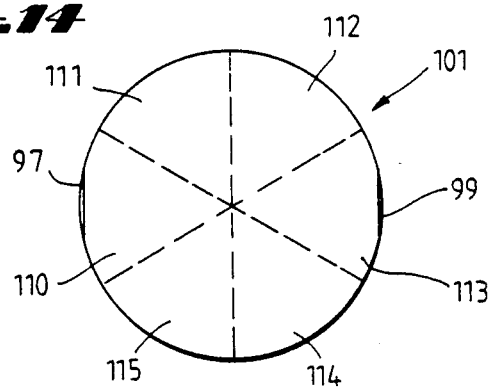
FIG. 14 is a plan view of the cleaved face of a diamond insert according to a preferred embodiment of the invention.

Reference is next made to FIG. 14 which illustrates a plan view of plane 98 of the diamond illustrated in FIG. 12E. The face of hemisphere 101 can be divided into six sections 110–115. Opposing sections 110 and 113 include notches 97 and 99. The remaining four sections 111, 112, 114 and 115 include a clean outer edge that can be used as the cutting edge for the diamond insert. When the edges of the diamond cutting elements become dull, the diamonds can be removed, rotated and used in a new bit.

As can be seen from the foregoing, the present invention provides a novel drill bit design which uses hemispherically shaped diamond inserts having a cleaved face as cutting elements. The inserts are positioned in the matrix of the bit to expose a sharp cutting surface which knives through the formation being drilled to provide faster penetration rates than other types of diamond drilling bits. The inserts can be formed by cleaving round diamonds in half or by polishing and cleaving diamonds to approximate a hemisphere.

While the invention has been described with respect to the presently preferred embodiments, it will be appreciated that changes and modifications can be made without departing from the scope or essential characteristics of the invention. Accordingly, the scope of the invention is defined by the appended claims rather than by the foregoing description. All changes or modifications which come within the meaning and range of equivalency of the claims are to be embraced within their scope.

I claim:

1. A method for forming a hemispherical diamond cutting element for a drill bit comprising:

obtaining a natural diamond;

identifying a cleaving plane is said diamond and an axis perpendicular to said cleaving plane;

polishing said diamond to form a series of truncated cones approximating a hemisphere, said cones having as their longitudinal axis said perpendicular axis; and cleaving said diamond to form a hemisphere.

2. A method to claim 1 further comprising cleaving opposing sides of said diamond perpendicular to said cleaving plane prior to polishing said diamond.

3. A method according to claim 1 wherein the number of truncated cones in greater than 2.

4. A method according to claim 3 wherein the number of truncated cones is 3.

5. A method for forming a hemispherical diamond cutting element for a drill bit comprising:

obtaining a natural diamond;

identifying a cleaving plane in said diamond and an axis perpendicular to said cleaving plane;

polishing said diamond to form a cylinder having as its longitudinal axis said perpendicular axis;

polishing an end of said cylinder to form a series of truncated cones approximating a hemisphere; and cleaving said diamond to form a hemisphere.

6. A method according to claim 5 further comprising cleaving opposing sides of said diamond perpendicular to said cleaving plane prior to polishing said diamond to form a cylinder.

7. A method according to claim 5 further comprising polishing a second end of said cylinder to form a series of truncated cones approximating a hemisphere and cleaving said diamond to form a second hemisphere.

8. A method according to claim 5 wherein the number of truncated cones is greater than 2.

9. A method according to claim 8 wherein the number of truncated cones is 3.

10. A method according to claim 5 further comprising cleaving additional portions of said cylinder to form discs.

* * * * *

UNITED STATES PATENT AND TRADEMARK OFFICE

CERTIFICATE OF CORRECTION

PATENT NO. : 4,989,578

DATED : February 5, 1991

INVENTOR(S) : Maurice P. Lebourg

It is certified that error appears in the above-identified patent and that said Letters Patent is hereby corrected as shown below:

Column 2, line 8, "havign" should read -- having --.

Column 5, line 57, after "formation" and before "disk" please insert -- is being drilled. Core cutting insert 46 is generally --.

Column 5, line 66, "east" should read -- easy --.

Column 6, line 12, "retartding" should read -- retarding --.

Column 7, line 3, "cut" should read -- cleaved --.

Column 8, line 19, "is" should read -- in --.

Column 8, line 27, after "method" and before "to", please insert -- according --.

Signed and Sealed this

Twenty-eighth Day of July, 1992

*Attest:*

*Attesting Officer*

DOUGLAS B. COMER

*Acting Commissioner of Patents and Trademarks*